United States Patent [19]

Molins et al.

[11] 4,185,941

[45] Jan. 29, 1980

[54] METHOD AND APPARATUS FOR ASSEMBLING ROD-LIKE ARTICLES

[75] Inventors: Desmond W. Molins; Brian H. Warner; Alan G. Claydon; Anthony W. Watson, all of Deptford, England

[73] Assignee: Molins Limited, United Kingdom

[21] Appl. No.: 815,199

[22] Filed: Jul. 12, 1977

[30] Foreign Application Priority Data

Jul. 22, 1976 [GB] United Kingdom ..... 30533/76

[51] Int. Cl.[2] ..... B65G 51/02

[52] U.S. Cl. ..... 406/77; 131/94; 198/425; 198/493

[58] Field of Search ..... 302/2 R, 11, 31; 198/420, 425, 493, 616; 131/94; 93/1 C, 77 FT; 406/77, 83, 84, 78, 79, 82

[56] References Cited

U.S. PATENT DOCUMENTS 2,990,831 7/1961 Molins ..... 198/425

3,131,612 5/1964 Rowlands ..... 198/425

3,160,443 12/1964 Harris et al. ..... 302/2 R

FOREIGN PATENT DOCUMENTS 955431 4/1964 United Kingdom ..... 131/94

*Primary Examiner*—Jeffrey V. Nase

*Attorney, Agent, or Firm*—Craig and Antonelli

[57] ABSTRACT

In the assembly of groups of component filter portions for forming into composite filter rods, predetermined leading components moving on a conveyor are retarded for a predetermined period while following components are consecutively conveyed into abutment. The assembly is improved by subjecting the components to an air stream along their direction of movement in the vicinity of the retarding means so that any gaps which may be present are closed up. A similar air stream can also be useful for closing up gaps in the production of a continuous rod from component filter portions.

15 Claims, 15 Drawing Figures

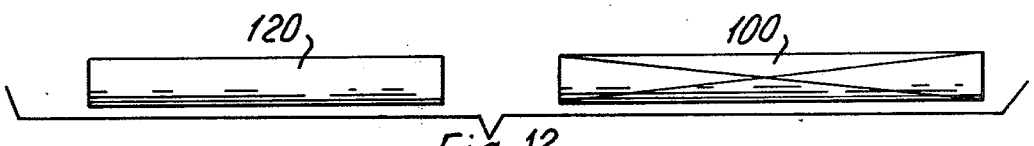
Fig. 12.
Fig. 13.
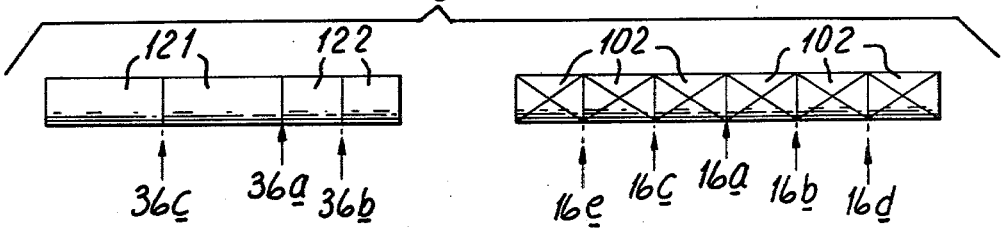
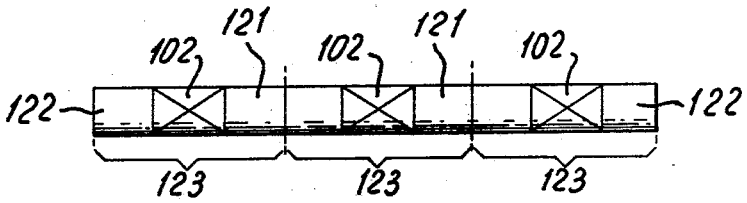
Fig. 14
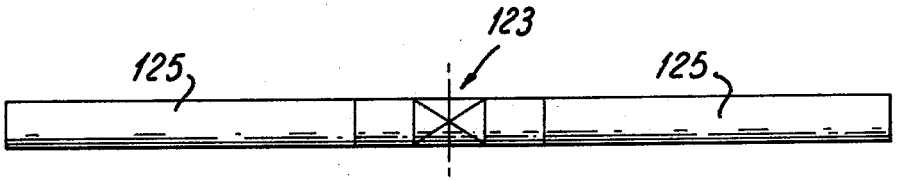
Fig. 15.

METHOD AND APPARATUS FOR ASSEMBLING ROD-LIKE ARTICLES

This invention relates to apparatus for assembling rod-like articles. The invention is applicable to the formation of a composite filter rod, from which composite filters, for incorporation in filter cigarettes, can be obtained by cutting the rod at appropriate positions.

It is known to form a composite filter rod by assembling filter portions of different materials in an alternating stream and continuously feeding the stream into the garniture of a continuous rod filter making machine where it is enclosed in a continuous wrapper web. It is also known to assemble alternating filter portions in aligned groups which are conveyed transversely to their lengths and a precut piece of wrapper material rolled and sealed around each group to form a composite filter rod. The present invention is concerned particularly, but not exclusively, with the assembly of groups of component filter portions, which may subsequently be formed into composite filter rods by uniting the components of each group.

According to the present invention apparatus for assembling rod-like articles comprises conveyor means for conveying a stream of rod-like articles in an endwise direction; retarding means for retarding articles relative to said stream; and means for supplying an air stream having a component of movement along the conveying direction of the stream of rod-like articles towards the retarding means, whereby articles are urged by said air stream towards the retarding means. In the assembly of groups using retarding means there is a tendency for the trailing articles in a group to still have gaps between them at the time when the leading article is released by the retarding means. Such gaps are created primarily by "bounce" as these articles are moved by the conveyor means against the already stopped (or slowed) articles of the group. An air stream moving in the same direction as the conveyor means helps prevent bounce and close up the gaps so that a group of abutting articles is formed.

It is to be noted that the present invention may be used in an in-line arrangement for producing a continuous rod in a garniture, as for example in the production of composite filter rod according to the disclosure of British Patent No. 971,491.

Figure 2:
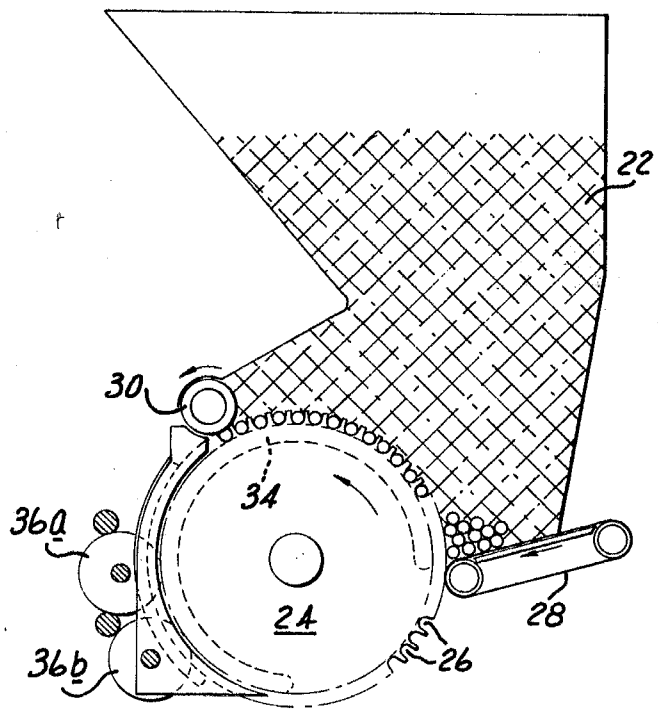
Figure 1:
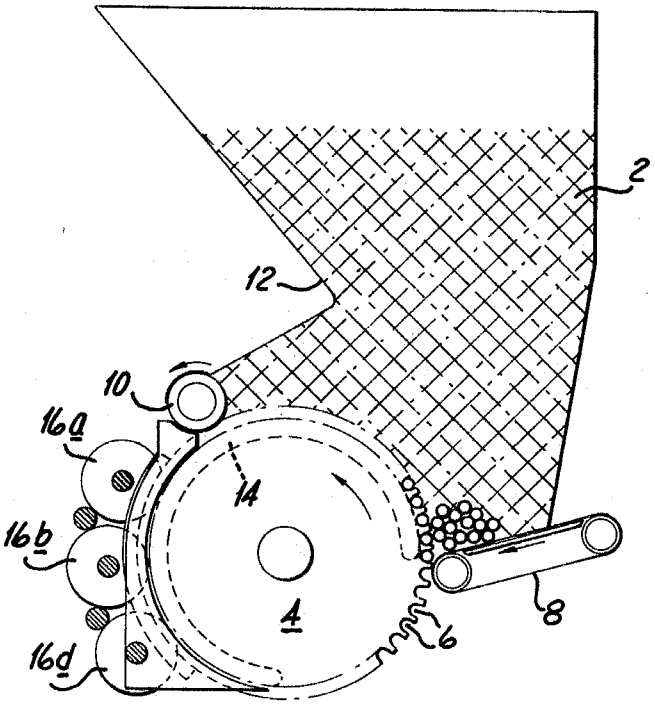
Figure 3:
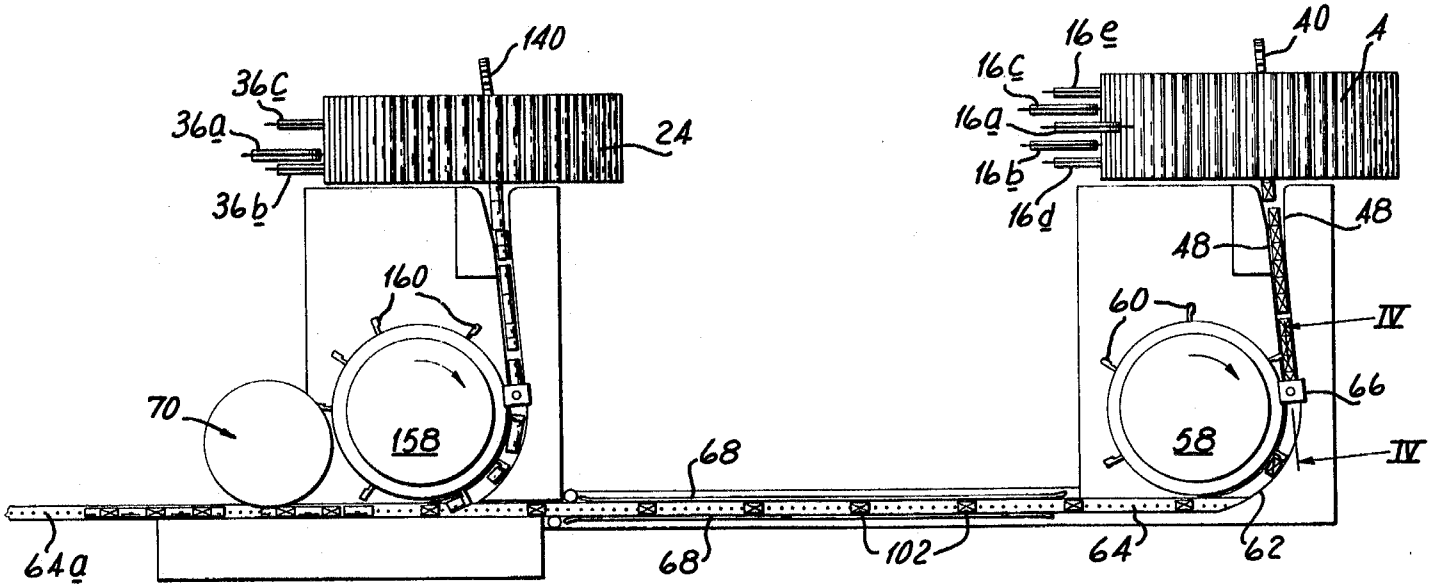
Figures 4, 5:
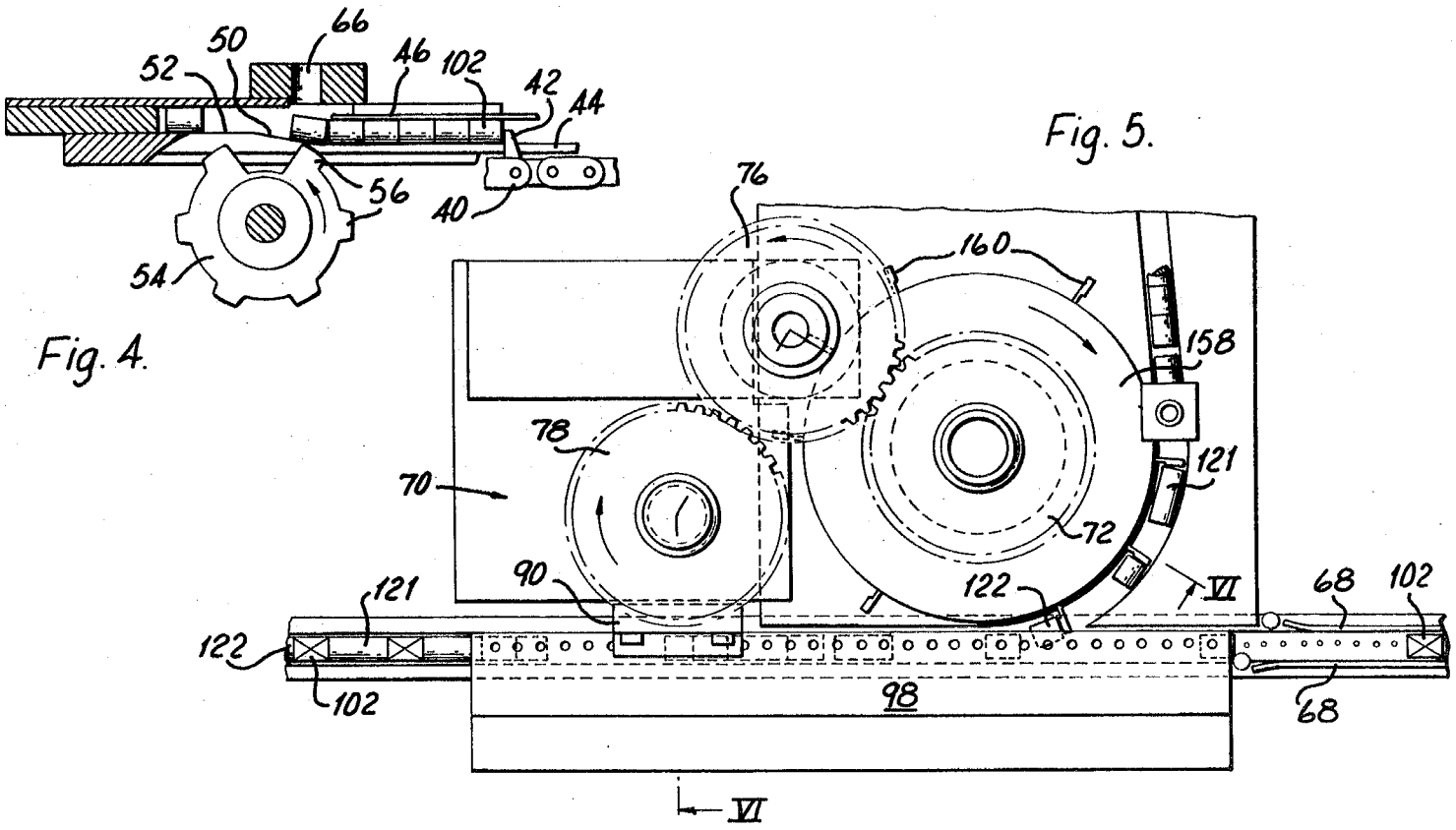
Figure 6:
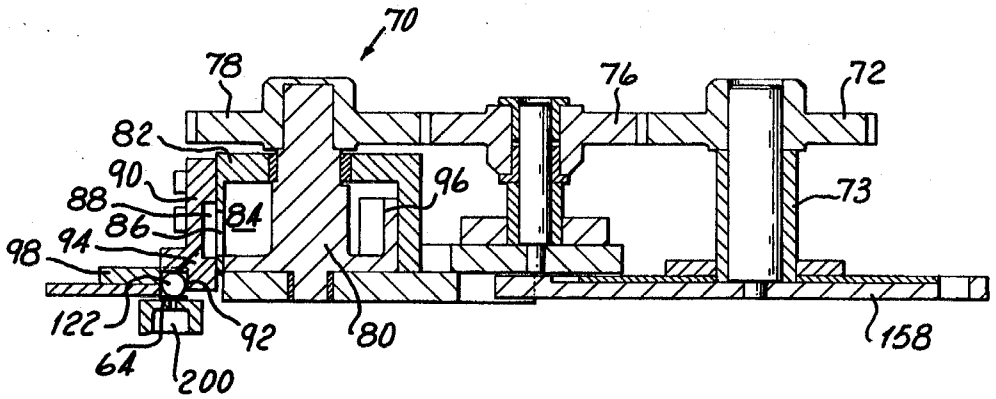
Figure 7:
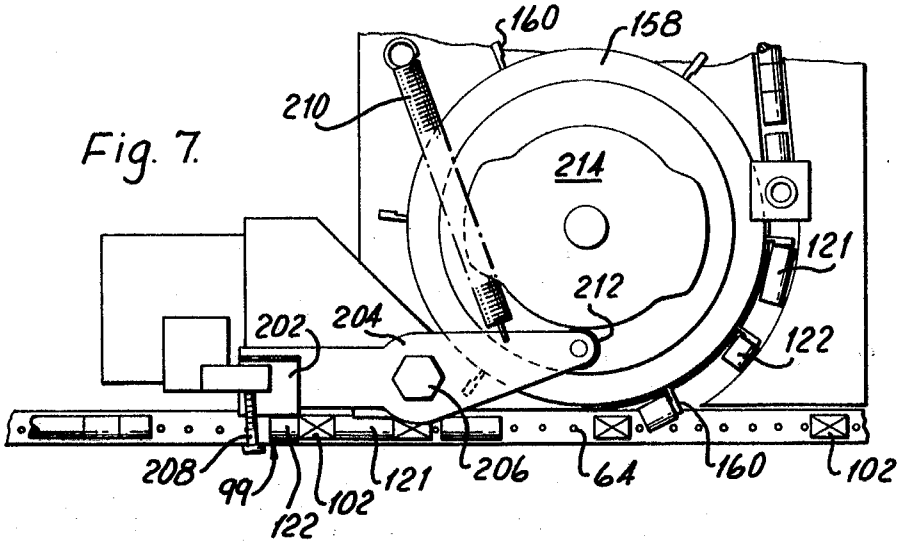
Figure 8:
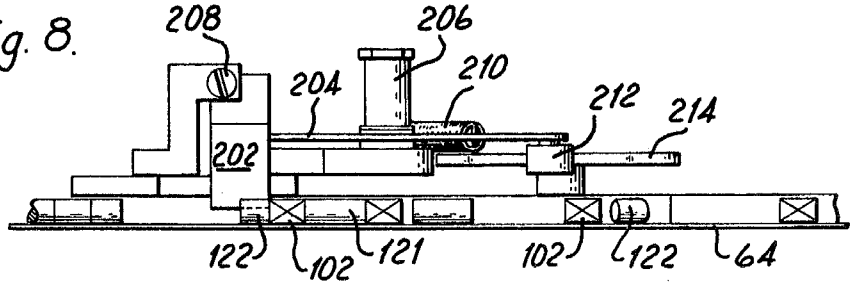
Figure 11:
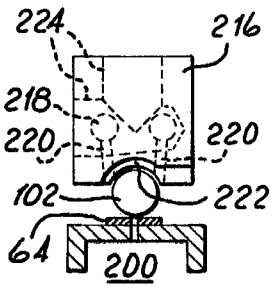
Figure 9:
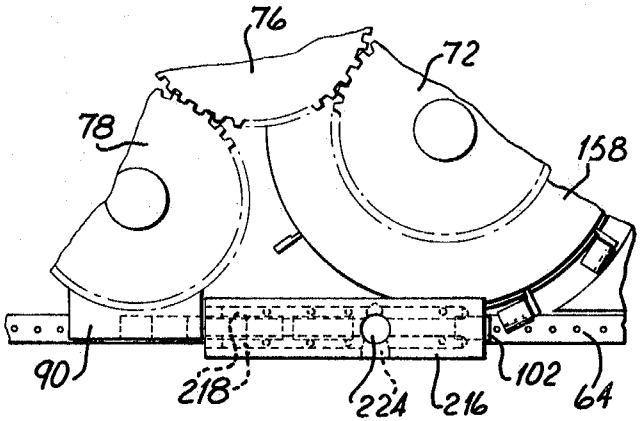
Figure 10:
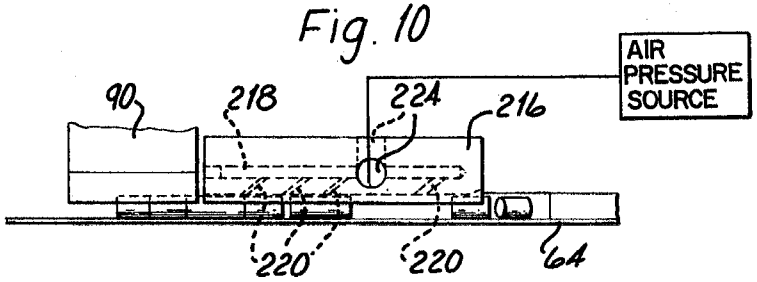

The invention will now be further described, by way of example only, with reference to the accompanying drawings, in which:

FIG. 1 is a sectional view of a hopper for rod lengths of one type of filter material, FIG. 2 is a sectional view of a hopper for rod lengths of another type of filter material, FIG. 3 is a diagrammatic plan view of apparatus for assembling groups of component filter portions, FIG. 4 is an enlarged sectional view on the line IV—IV in FIG. 3, FIG. 5 is a plan view of part of the apparatus of FIG. 3, FIG. 6 is a sectional view on the line VI—VI of FIG. 5, FIG. 7 is a plan view of a modification of part of the apparatus of FIG. 3, FIG. 8 is a side view of the apparatus shown in FIG. 7, FIG. 9 is a plan view of an additional part of the apparatus of FIG. 3, FIG. 10 is a side view of the apparatus shown in FIG. 9, FIG. 11 is a sectional view on the line XI—XI of FIG. 10, FIG. 12 is a diagram showing a rod length from each of the hoppers of FIGS. 1 and 2, FIG. 13 is a diagram indicating how each of the rod lengths of FIG. 12 is divided into component filter portions, FIG. 14 is a diagram of a group of component filter portions, and FIG. 15 shows an assemblage comprising a double length composite filter portion placed between two tobacco filler lengths.

FIG. 1 shows a hopper 2 for receiving and holding rod-lengths of a first type of filter material, such as a tow of cellulose acetate fibers. The hopper 2 is arranged to supply rod lengths to a drum 4 having flutes 6. The lower part of the hopper 2 has a driven band 8 and a refuser roller 10 mounted on opposite sides of an arc of the drum 4. The hopper has a re-entrant side wall 12. The flutes 6 of the drum 4 receive suction from a manifold 14.

The drum 4 is provided with five peripheral grooves, into which project five rotary cutting knives 16*a*, 16*b*, 16*c*, 16*d* and 16*e* (see also FIG. 3). A rod length 100 delivered by the hopper 2 and carried in a flute 6 is shown in FIG. 12. This rod is divided into six equal length component filter portions 102 by the knives 16 in the sequence indicated in FIG. 13. Typically the rod 100 may be 72 mm long so that each portion 102 has a length of 12 mm.

A hopper 22 for rod-lengths of a second type of filter material, such as myria or other paper-like material, is shown in FIG. 2. The hopper 22 supplies rod lengths to a fluted drum 24 in the same way as the hopper 2 supplies rods to the drum 4 and has a driven band 28 and refuser roller 30.

The drum 24 is similar to the drum 4 and has flutes 26 which receive suction from a suction manifold 34. However, the drum 24 is provided with only three peripheral grooves, into which project three rotary cutting knives 36*a*, 36*b* and 36*c* (see also FIG. 3). A rod length 120 delivered by the hopper 22 and carried in a flute 26 is shown in FIG. 12. This rod is divided into two long component filter portions 121 and two short component filter portions 122 by the knives 36 in the sequence indicated in FIG. 13. Typically the rod 120 may be 60 mm long and the portions 121 and 122 of length 20 mm and 10 mm respectively.

The hoppers 2 and 22 and the drums 4 and 24 form part of the apparatus shown in FIG. 3. The component filter portions obtained by severing the rods 100 and 120 in the drums 4 and 24 respectively are maintained under suction control from the respective manifolds 14 and 34 up to a release position at the bottom of each drum. Referring particularly to the arrangement associated with the drum 4, a chain conveyor 40 having extending lugs or pusher members 42 (see FIG. 4) passes beneath the drum at this release position. The conveyor 40 is inclined to the axis of the drum 4 and a lug 42 on the upper run of the conveyor 40 extends upwardly into the lowermost flute 6. The conveyor 40 is arranged so that a lug 42 can enter the lowermost flute 6 at one end of the rotating drum 4 and pass through it, due to its component of motion in the direction of motion of the flute. The lugs 42 are spaced apart on the conveyor 40 so that successive lugs enter and pass through successive flutes 6.

A slotted lower guide plate 44 (FIG. 4) is provided to support component filter portions 102 which are fed endwise by the lugs 42. An upper guide plate 46 and side walls 48 (FIG. 3) are also provided. The guide plate 44 has an upwardly inclined portion 50 which leads to a further horizontal guide surface 52 at a higher level.

A disc 54 having spaced fingers 56 is mounted so that on rotation successive fingers 56 will register with successive portions 102 conveyed in groups of six by the lugs 42. Mounted alongside the guide plate 44 is a rotatable turntable 58 (FIG. 3) provided with six equally spaced pushers 60. The speed of rotation of the turntable 58 and the timing of the pushers 60 are so related to the speed and timing of the conveyor 40 and lugs 42, as well as the fingers 56, that a pusher 60 moves across the surfaces 50 and 52 each time a filter portion 102 has been moved upwardly by the surface 50 and a finger 56. The surface 52 extends alongside the turntable 58 and an arcuate guide surface 62 around the turntable is provided for the portions 102. The pushers 60 subsequently transfer the portions 102 at regular intervals onto a suction conveyor tape 64.

The arrangement described above with reference to FIGS. 3 and 4 is somewhat similar to an arrangement disclosed in British Patent No. 876,732, to which reference is directed for a more detailed description.

In order to aid displacement of the filter portions 102 out of line by the ramp 50 and fingers 56, suction lift may be provided. It may be possible to dispense with the disc 54 and fingers 56 and rely simply on suction, which may be timed. Means for applying suction in the region above the ramp 50 is indicated at 66 in FIGS. 3 and 4.

The feed arrangement from the drum 24 is generally similar to that from the drum 4 with minor modifications to take account of the different lengths of the component filter portions 121 and 122. The feed comprises a conveyor 140 and a turntable 158 having spaced pushers 160 which transfer the portions onto the conveyor 64 at a position downstream of the turntable 58.

The pushers 160 are not spaced evenly on the turntable 158 and in fact comprise two groups of four so that the turntable conveys the filter portions from two rods 120 during one revolution. The irregular spacing of the pushers 160 is a consequence of the unequal lengths of the portions 121 and 122 and also of the particular spacing of the portions required on the conveyor 64.

As shown in FIG. 3 regularly spaced component filter portions 102 delivered from the turntable 58 are conveyed on the conveyor 64 between side rails 68. The turntable 158 is timed relative to the turntable 58 so that the portions 121 and 122 are inserted (intercalated) into the spaces between the portions 102. The delivery from the turntable 158 is such that every third space receives two spaced portions 122 and the other two spaces each receive a portion 121. Thus each space between the first filter portions 102 receives an equal length of second filter portion since the portions 121 are twice the length of the portions 122.

After intercalation there are still gaps between each of the component filter portions in the stream on the conveyor 64. In order to close these gaps up, timed braking means, indicated diagrammatically at 70 in FIG. 3, is provided to retard the selected leading component filter portion of a group so that the conveyor 64 moves underneath this portion and the following component filter portions are successively brought into abutment. The braking means is operated for a predetermined period, just sufficient to allow a selected group of component filter portions to move into abutment, and then released so that the group as a unit is subsequently conveyed by the conveyor 64. The braking means is operated again after a predetermined interval to retard the component filter portion immediately following the group.

One form of braking means 70, which uses suction to retard filter portions on the conveyor 64, is illustrated in FIGS. 5 and 6. A gear wheel 72 is connected to a spindle 73 which is coaxial with and rotatable with the turntable 158. The gear wheel 72 meshes with an idler gear wheel 76 which in turn meshes with a further gear wheel 78 which is keyed to a rotor 80 rotatable in a fixed cylindrical housing 82 defining a suction chamber 84. The housing 82 includes an opening 86 leading into a chamber 88 in a member 90 which partly surrounds the housing and which has an arcuate surface 92 positioned adjacent the conveyor 64 (see FIG. 6). The chamber 88 is connected to the surface 92 by a passage 94. The rotor 80 is provided with two opposite arcuate portions 96, (only one of which is shown in the drawings) which are a close fit within the housing 90 and which each block the opening 86 for a predetermined angle of rotation of the rotor.

The connection between the turntable 158 and the rotor 80 is such that suction is applied through the opening 86, chamber 88 and passage 94 to arrest axial movement of and hold the trailing filter portion 122 of each pair of portions 122 on conveyor 64, so that said trailing filter portion 122 becomes the leading component filter portion of a group. Suction is maintained to hold said portion 122 against the surface 92 while the conveyor 64 moves underneath it and successive further components of a group are brought into abutment behind it. A complete group is shown in FIG. 14. As soon as the group as shown in FIG. 14 becomes abutted the opening 86 is blocked so that suction on the leading portion 122 is released and the group is carried away by the conveyor 64. The opening 86 remains blocked until the next trailing filter portion 122 (i.e. of a pair of adjacent portions 122) moves under the surface 92 when suction is again applied to hold it as a portion 96 of the rotor 80 moves away from the opening 86.

As shown in FIGS. 5 and 6 a shroud 98 is provided so that additional guidance is available for the filter portions on the conveyor 64. In addition, the conveyor 64 runs on a surface forming an upper wall of an enlarged suction chamber 200 so that increased suction can be applied in the area of intercalation to provide more positive control. The suction applied through the passage 94 must of course be sufficient to overcome suction applied through the conveyor band 64.

The application of suction to the passage 94 (and the removal thereof) cannot be instantaneous: it may be preferable to provide several smaller passages which receive suction in turn in order to arrest the movement of the leading filter portion in a more controlled manner. Moreover, since the movement of the rotor 80 is essentially parallel to that of the conveyor 64, an undesirable suction gradient may exist across the passage 94 in the direction of the conveyor 64 during movement of a portion 96 across the opening 86. One possible way of avoiding this effect is to arrange for the rotor to rotate about a different axis, preferably an axis parallel to the length of the conveyor 64, so that the tendency of any suction gradient to drag filter portions backwards or forwards on the conveyor 64 would be reduced.

A mechanical brake for forming groups of component filter portions is shown in FIGS. 7 and 8. This comprises a clamping member 202 mounted at one end of a lever 204 which is pivoted on a fixed spindle 206. The lever 204 is normally maintained in contact with an adjustable stop 208 by means of a tension spring 210 so that the leading filter portion of a group is lightly clamped against a side wall 99 forming part of the shroud 98. The other end of the lever carries a roller 212 which is displaceable by a cam 214 rotatable with the turntable 158. The cam 214 moves the clamping member 202 by a sufficient distance to release the filter portion. The formation of groups on the conveyor 64 using the mechanical brake of FIGS. 7 and 8 is the same as the formation using the suction brake of FIGS. 5 and 6. An alternative form of mechanical brake which could be used is disclosed in British Pat. No. 917,701.

Whichever form of retarding means is used there is the possibility, especially at high operating speeds, that the rearmost filter portion or portions in a group will not be completely abutted at the time the brake releases the group to be carried away by the conveyor 64. Where this condition is present the cause is normally bounce of the rearmost filter portion or portions. While slight gaps between components of a group can be tolerated subsequent handling of the groups is easier if these gaps are kept to a minimum.

One device aimed at reducing the occurrence of gaps is shown in FIGS. 9, 10 and 11. This device comprises a plastics moulding 216 mounted over the conveyor 64 in the region upstream of the braking means. In FIGS. 9 to 11 the device is shown in use with a suction braking means of the type illustrated in FIGS. 5 and 6 and is arranged immediately adjacent to the member 90. The device could also be used with braking means as shown in FIGS. 7 and 8. The moulding 216 contains two parallel axial chambers 218 and a number of inclined bores 220 leading from these chambers to the sides of an arcuate groove 222 on the lower surface of the moulding. Larger bores 224 extend from the upper and side surfaces of the moulding 216 and communicate with the chambers 218. Air under pressure (either continuous or pulsed) may be supplied to one of the bores 224 (the other being blocked) so that air admitted to the chambers 218 is expelled through the inclined bores 220. The streams of air from these bores 220 have components along the direction of movement of the conveyor 64 and thus urge filter portions in this direction independently of the conveyor, thereby providing an additional factor tending to reduce the occurrence of gaps in the groups. The rearmost of the bores 220 are slightly wider than the other bores 220.

Referring once again to FIG. 3 groups of component filter portions released by the brake means 70 move on to the region **64*a* of conveyor 64 and each group is subsequently united in any convenient manner to form a composite filter rod. For example, successive groups may be transferred from the region 64*a*** onto a series of drums on which each group is rolled and sealed in one or more uniting bands.

Composite filter rods produced from groups as shown in FIG. 14 are passed to a machine for assembling filter cigarettes where they are divided into three double length composite filters 123, as shown in FIG. 14. In this machine each filter 123 is placed between and joined to two tobacco filter lengths 125 as shown in FIG. 15. The resulting assemblage is divided at its modpoint to produce two individual filter cigarettes, each having a composite filter which comprises, in the present case, 10 mm of the second filter material adjacent to the tobacco and 6 mm of the first filter material at the exposed end.

The illustrated apparatus is primarily intended for forming separate groups of component filter portions for forming into composite filter rods but braking means could be operated to substantially close up all the gaps between the component filter portions so that a continuous stream of said portions on the conveyor 64 could be supplied to a garniture for forming into composite filter rod in a conventional in-line process such as that described in British Pat. No. 971,491. In this case the braking means could be replaced by simpler means such as a spring finger which would retard each portion sufficiently to close up gaps. The use of the air stream to reduce the tendency to bounce as component filter portions are retarded could still be advantageous.

We claim:

1. Apparatus for assembling rod-like articles comprising conveyor means for conveying a stream of rod-like articles in an endwise direction; retarding means for retarding selected articles relative to said stream to form spaced groups of articles; guide means extending along and spaced above said conveyor means to define a path for said stream along said conveyor means upstream of said retarding means; and means for supplying an air stream from said guide means having a component of movement along said path in the conveying direction of the rod-like articles towards the retarding means, said means for supplying an air stream includes means for supplying said stream as a series of intermittent pulses, whereby articles are urged by said air stream towards the retarding means to ensure that the articles of each group are in abutting relationship.

2. Apparatus as claimed in claim 1 wherein said means for supplying an air stream includes a plurality of air outlets spaced along said path.

3. Apparatus as claimed in claim 2 wherein the means for supplying an air stream further includes air outlets spaced transversely of said path.

4. Apparatus as claimed in claim 1 wherein the guide means includes a channel having an arcuate cross section and at least one air outlet in said channel.

5. Apparatus as claimed in claim 4 wherein said channel is arranged immediately upstream of said retarding means.

6. Apparatus as claimed in claim 1 wherein the conveyor means is an endless band conveyor.

7. Apparatus as claimed in claim 1, wherein said means for supplying an air stream from said guide means is arranged so that said air stream includes a component directed at said conveyor means.

8. Apparatus as claimed in claim 1, wherein said means for supplying an air stream is spaced from said retarding means by a distance greater than a length of at least two of said articles.

9. Apparatus for assembling rod-like articles comprising conveyor means for conveying a stream of rod-like articles in an endwise direction; retarding means for retarding selected articles relative to said stream to form spaced groups of articles; guide means extending along and spaced above said conveyor means to define a path for said stream along said conveyor means upstream of said retarding means; and means for supplying an air stream from said guide means having a component of movement along said path in the conveying direction of the rod-like articles towards the retarding means, the means for supplying an air stream includes a guide channel for said stream of rod-like articles and at least one air outlet in said channel, the guide means comprises a member having a channel formed in one surface and having at least one bore extending parallel to said channel, and further provided with a plurality of subsidiary bores leading from said bore to said channel to serve as air ducts, whereby articles are urged by said air stream towards the retarding means to ensure that the articles of each group are in abutting relationship.

10. Apparatus as claimed in claim 9, wherein said subsidiary bores are inclined to path to provide an air stream along said path.

11. Apparatus as claimed in claim 10, wherein said subsidiary bore or bores furthest from the retarding means is of larger diameter than the other subsidiary bore or bores.

12. Apparatus for assemblying rod-like articles comprising endless conveyor means for conveying a stream of rod-like articles in an endwise direction; retarding means for retarding articles relative to said stream; guide means extending upstream from said retarding means along and above said conveyor means, said guide means including a channel having an arcuate cross section and defining with said conveyor means a path for said stream of articles, said channel having two transversely-spaced series of air outlets along its length for directing a plurality of air streams towards and along said conveyor means towards said retarding means.

13. Apparatus as claimed in claim 12 including means for operating said retarding means intermittently at predetermined times for predetermined intervals, whereby selected spaced articles of said stream are retarded and subsequently released so that spaced groups of articles are further conveyed by said conveyor means, said channel of said guide means including at least one air outlet located at a position spaced from the retarding means by a distance exceeding the length of a group of articles to be assembled.

14. Apparatus as claimed in claim 13 wherein said one air outlet is arranged so that it may supply air at a greater rate than an air outlet nearer the retarding means.

15. Apparatus for assembling rod-like articles comprising conveyor means for conveying a stream of spaced rod-like articles in an endwise direction, retarding means for retarding articles relative to said stream for a predetermined period to close up gaps between a plurality of said articles, guide means spaced above said conveyor means to define a path for said stream along said conveyor means and extending upstream of said retarding means by a distance exceeding a length of at least two of articles, and means for supplying an air stream from said guide means having a component of movement along said path in the conveying direction of the rod-like articles towards the retarding means, said means for supplying an air stream includes means for supplying said stream as a series of intermittent pulses, whereby articles are urged by said air stream towards the retarding means to ensure that the articles in said plurality of articles are in abutting relationship.

* * * * *